US007226639B2

(12) United States Patent
Olry et al.

(10) Patent No.: US 7,226,639 B2
(45) Date of Patent: Jun. 5, 2007

(54) CARBONIZATION OF CELLULOSIC FIBROUS MATERIALS IN THE PRESENCE OF AN ORGANOSILICON COMPOUND

(75) Inventors: Pierre Olry, Bordeaux (FR); Hervé Plaisantin, Gradignan (FR); Sylvie Loison, Saint Medard en Jalles (FR); René Pailler, Cestas (FR)

(73) Assignee: SNECMA Propulsion Solide, Le Haillan (FR)

( * ) Notice: Subject to any disclaimer, the term of this patent is extended or adjusted under 35 U.S.C. 154(b) by 30 days.

(21) Appl. No.: 10/148,778

(22) PCT Filed: Dec. 5, 2000

(86) PCT No.: PCT/FR00/03389

§ 371 (c)(1),
(2), (4) Date: Jun. 4, 2002

(87) PCT Pub. No.: WO01/42544

PCT Pub. Date: Jun. 14, 2001

(65) Prior Publication Data

US 2002/0182139 A1 Dec. 5, 2002

(30) Foreign Application Priority Data

Dec. 6, 1999 (FR) ..... 99 15329

(51) Int. Cl.
*B05D 3/02* (2006.01)

(52) U.S. Cl. ..... 427/227; 427/226

(58) Field of Classification Search ..... 427/226, 427/227, 228, 229

See application file for complete search history.

(56) References Cited

U.S. PATENT DOCUMENTS 3,628,985 A * 12/1971 Hider et al. ..... 427/228
4,003,702 A * 1/1977 Knott ..... 8/140
4,295,871 A * 10/1981 Droux et al. ..... 65/448
4,370,385 A * 1/1983 Yoshida et al. ..... 428/429
5,562,761 A * 10/1996 Dirschl et al. ..... 252/8.62
5,658,484 A * 8/1997 Lohmann et al. ..... 252/8.57
5,766,322 A * 6/1998 Leiser et al. ..... 106/2
6,605,123 B1 * 8/2003 Kasson et al. ..... 8/142

FOREIGN PATENT DOCUMENTS

FR 1 307 291 A 2/1963
GB 1 130 304 A 10/1968
GB 1 222 881 A 2/1971
GB 1 301 101 A 12/1972

OTHER PUBLICATIONS

Database WPI: Section Ch, Week 199624, Derwent Publications Ltd., London, GB; AN 1996-237811 (XP002136072); and RU 2 045 472 C (Kazakov, M.E.), Oct. 10, 1995, cited in the application abstract.

Database WPI: Section Ch, Week 199952, Derwent Publications Ltd., London, GB; AN 1999-603671 (XP002136073); and JP 11 240779 A (Tokai Carbon KK), Sep. 7, 1999, abstract.

* cited by examiner

*Primary Examiner*—Fred J. Parker
(74) *Attorney, Agent, or Firm*—Weingarten, Schurgin, Gagnebin & Lebovici LLP

(57) ABSTRACT

The subject of the present invention is a method of obtaining fibrous carbon materials by carbonization of cellulosic fibrous materials carried out continuously or batchwise in the presence of at least one organosilicon compound. Characteristically, said organosilicon compound is chosen from the family of crosslinked, cyclic or branched oligomers and resins, which have a number-average molecular mass of between 500 and 10 000 and which consist of units of formula $SiO_4$ (called $Q_4$ units) and units of formula $SiO_xR_y(OR')_z$.

14 Claims, No Drawings

CARBONIZATION OF CELLULOSIC FIBROUS MATERIALS IN THE PRESENCE OF AN ORGANOSILICON COMPOUND

The subject of the present invention is a method of carbonizing cellulosic fibrous materials in the presence of at least one organosilicon compound for the purpose of obtaining fibrous carbon materials. Said carbonization may be carried out both continuously and batchwise. The fibrous carbon materials obtained may then be heat treated (especially graphitized) in order to generate fibers having the desired properties.

Carbon fibers having a cellulosic precursor were the first carbon fibers manufactured in the world. Starting from such cellulosic precursors, Edison, at the end of the 19th century, obtained filaments for his incandescent lamps (U.S. Pat. No. 223,898).

However, polyacrylonitrile has proved for a long time to be a more suitable precursor for obtaining high-strength high-modulus carbon fibers, more particularly those intended for the reinforcement of composites.

However, carbon fibers from viscose have been used since 1955 in the manufacture of carbon/phenolic resin composites employed as thermal protection for propulsion units. These low-modulus fibers have a restricted thermal conductivity. Manufacturing these fibers requires a particular rayon-type precursor: a rayon having a disoriented crystalline texture (R. Bacon, "Carbon Fibers from Rayon Precursors" in *Chemistry and Physics of Carbon,* 1973, Vol. 2, Marcel Dekker, N.Y. and P. Olry, 14th Biennial Conference on Carbon, 1979).

More recently, it has proved possible to carbonize, with useful results, rayons of another type, especially highly oriented rayons, thanks to the intervention of an organic silicon derivative during carbonization.

Thus, continuous carbonization of unidirectional fabrics or webs of cellulose fibers has proved possible and resulted in carbon fabrics or carbon yarns, having a strength appreciably better than that of fabrics or yarns obtained by the conventional method (which comprises batchwise precarbonization followed by continuous carbonization), on condition that said fabric or said web be preimpregnated with a few percent of an organosilicon product. This has been described in particular in Russian patents RU 2045472 and 2047674.

Said organosilicon product was disclosed therein as an oligomer chosen from polydimethyl phenylallylsilanes, polysiloxanes, polymethylsiloxanes, polysilazanes and polyaluminoorganosiloxanes. In fact, its precise nature is not really specified.

Said patent RU 2047674 also discloses the advantage of making use, on the cellulosic substrates to be carbonized, apart from said organosilicon product, of a mineral additive called a "fire-retarding compound", such as $NH_4Cl$.

In this context, the novelty of the present invention lies in the selection of specific organosilicon compounds—additives for the carbonization of cellulosic fibrous materials—which are particularly effective. Said compounds have proven to be very efficient for improving the properties of the carbon fibers obtained from the carbonization, this being so with any type of carbonized cellulosic material (especially commercial staple fibers and rayons), whether said carbonization is carried out continuously or batchwise. Nevertheless, although the use of said compounds constitutes an undeniable benefit when carrying out carbonizations batchwise and continuously, it proves to be indispensable for the continuous carbonization of certain substrates (it makes said continuous carbonization of said substrates possible). The present invention therefore relates to the use of one particular family of organosilicon compounds within said context.

The subject of the present invention is in fact a method of obtaining fibrous carbon materials by carbonization of cellulosic fibrous materials carried out continuously or batchwise in the presence of at least one organosilicon compound. Characteristically, said organosilicon compound is chosen from the family of crosslinked, cyclic or branched oligomers and resins, which have a number-average molecular mass of between 500 and 10 000 and which consist of units of formula $SiO_4$ (called $Q_4$ units) and units of formula $SiO_xR_y(OR')_z$ in which:

x, y and z are integers such that $x+y+z=4$ and $1 \leqq x \leqq 3$, $0 \leqq y \leqq 3$ and $0 \leqq z \leqq 3$;

R represents hydrogen or a linear or branched alkyl radical having from 1 to 10 carbon atoms, different R groups being capable of occurring in the same unit when $y \geqq 2$;

R' represents, independently of R, hydrogen or a linear or branched alkyl radical having from 1 to 10 carbon atoms, different R' groups being capable of occurring in the same unit when $z \geqq 2$; given that:

for oligomers having a number-average molecular mass of less than 1000, $z \neq 0$ in said formula $SiO_xR_y(OR')_z$; and for resins having a number-average molecular mass of greater than 2000, $y \neq 0$, in said formula $SiO_xR_y(OR')_z$.

It is assumed that the increase in the strength of the filaments during carbonization in the presence of such additives, compared with that of filaments carbonized without an additive, is due to the bridging of the carbon chains during aromatization by said additives and/or their transformation products. This reinforcement of the carbon network takes place only at the surface of the fibers, but the reduction in surface defects which results therefrom causes a substantial increase in the strength of the filaments.

The magnitude of this reinforcement, with the additives of the invention, is remarkable. It makes it possible to counteract the shrinkage during carbonization and even to stretch the fibers (up to 50%) without them breaking, thereby ensuring orientation of the texture of said fibers and a reduction in or rearrangement of the internal pores. It has made it possible to obtain, with any type of cellulose (solvent celluloses and rayons especially for tires), filaments which have strengths of around 1500 to 2000 MPa and moduli of around 70 to 110 GPa.

The family of organosilicon compounds selected within the context of the present invention is that of silicon oligomers and resins, as defined above.

Said family in fact includes two subfamilies, on the one hand that of oligomers of partially hydrolyzed organic silicates, which are volatile at the temperatures of use, and, on the other hand, that of resins, which are solid products at room temperature, these being deposited by impregnation, advantageously dissolved in a solvent.

Said oligomers and resins have a number-average molecular mass of between 500 and 10 000, advantageously between 2 000 and 5 000. In general, the oligmers have a number-average molecular mass of between 500 and 2 000, more generally between 500 and 1 000, and the resins have a number-average molecular mass of between 1 000 and 10 000, more generally between 2 000 and 10 000.

Said oligomers and resins have in their chemical structure the units of formulae $SiO_4$ and $SiO_xR_y(OR')_z$, as defined above.

For all useful purposes, it will be recalled here that units of formula $SiO_xR_y(OR')_z$, with x=1, y=3 and z=0 are called M units, those with x=3, y=0 and z=1 are called $Q_3$ units, those with x=2, y=2 and z=0 are called D units, and those with x=3, y=1 and z=0 are called T units.

Moreover, the units of formula $SiO_4$ are called $Q_4$ units.

Incidentally, it should be noted here that the alkyl radicals R and/or R' (in the formula $SiO_xR_y(OR')_z$) are advantageously $C_1$–$C_4$ lower alkyl radicals, very advantageously methyl or ethyl radicals, particularly preferably methyl radicals.

Among organosilicon compounds in this family (itself consisting of the subfamily of oligomers and that of resins, as defined above), the oligomers and resins as specified below are most particularly preferred within the context of the present invention.

According to a first preferred variant, the organosilicon compound involved (incidentally, it will be recalled that it is not excluded from the scope of the invention for several organosilicon compounds to be involved jointly) is a resin called an MQ resin, consisting of units of formula $SiO_4$ ($Q_4$ units), units of formula $SiO_3$—OH ($Q_3$ units) and units of formula O—Si—$R_3$ (M units). The combined presence of $Q_3$ and M units is opportune. Within the context of this first preferred variant, said MQ resin has $n_1$ $Q_4$ units, $n_2$ $Q_3$ units and $n_3$ M units, advantageously with:

$2 \leqq n_1 \leqq 70$ $3 \leqq n_2 \leqq 50$ $3 \leqq n_3 \leqq 50$ and a number-average molecular mass of between 2 500 and 5 000.

It was seen above that such a resin is generally solid at room temperature. In fact, it is assuredly solid when $n_1+n_2+n_3 \geqq 10$.

Resins of this type are commercially available.

According to a second preferred variant, the organosilicon compound involved (in this context here, it is also possible for several organosilicon compounds to be involved jointly) is chosen from oligomers of a partially hydrolyzed organic silicate, advantageously chosen from oligomers of a partially hydrolyzed alkyl silicate, and preferably chosen from oligomers of partially hydrolyzed ethyl silicate.

With this type of organosilicon compound, the inventors have obtained useful results (in terms of mechanical strength of the carbon fibers produced), similar to those obtained with resins, of the abovementioned MQ type. It seems reasonable, to believe that, owing to the effect of temperature and of the water released from the cellulose, the vapors from said compounds ("volatile" oligomers) continue to polymerize on the fibers undergoing carbonization, generating products of the type of said MQ resins, which products therefore have the same effects as said resins on improving the resulting carbon. Said oligomers of precursors of such resins could be termed . . .

Within the context of this second preferred variant, it is most particularly recommended to use an oligomer of partially hydrolyzed ethyl silicate, especially that of an oligomer of this type, manufactured on a large scale in the silicones industry, this being known by the name TEOS 40 (and especially sold by Bayer under the reference TES 40). This is an oligomer of tetraethylorthosilicate (TEOS 28) obtained by partially hydrolyzing the latter.

The commercial product is in fact a mixture of ethyl silicate (1 $SiO_4$ tetrahedron with 1 silicon atom per molecule) and of oligomers of said silicate which contain up to 9 $SiO_4$ tetrahedra, including those of the ends of molecules which have $SiO_3$—OH units ($Q_3$ units). Said product progressively distills from room temperature up to 500° C.

By pyrolyzing viscose yarns, in nitrogen enriched with vapors of said TEOS 40, the inventors have obtained carbon fibers having remarkable mechanical properties.

In fact, whatever the actual mechanism involved, the use of TEOS 40 and/or of similar compounds forms an integral part of the present invention.

Having specified above the nature of the organosilicon compounds, selected according to the invention, it is now proposed to describe their method of use in an entirely nonlimiting manner. In fact, two methods of use are recommended, depending on the nature of said compound.

If it is a nonvolatile compound (i.e. one which remains to a large extent solid and/or liquid at temperatures in the region of 400° C.), it is advantageously used prior to carbonization; the cellulosic fibrous materials being preimpregnated with the latter and said impregnation being made possible, or even optimized, generally by means of the use of at least one, generally one, solvent and/or of at least one, generally one, film-forming agent, . . .

To impregnate the cellulosic fibrous materials, before they are carbonized, with such nonvolatile organosilicon compounds (with such an organosilicon compound or with at least two such organosilicon compounds), said compounds are therefore generally used dissolved in a solvent, which solvent, such as perchloroethylene, is easily removed before carbonization. In order for said compounds to be properly dissolved in said solvent and above all to obtain a uniform film on the surface of the impregnated cellulosic fibrous materials, it is strongly recommended for (at least) one film-forming agent to be included in the solution. Such a film-forming agent is advantageously chosen from silicon oils of suitable viscosity (said viscosity generally being between 500 and 10 000 mPa.s, advantageously between 500 and 5 000 mPa.s) . Such oils may especially have one or other of the following formulae $(—Si(CH_3)_2—O)_n$ or $(—Si(CH_3)_2—O—Si(C_5H_6)_2—O)_n$.

Such oils depolymerize around 400° C. and a priori play no role in the chemical reinforcement of the surface of the fibers. However, they prevent bridging of the filaments with the cellulose pyrolysis products (tars), which bridging could result in weakening of the yarns.

However, the inventors have noted that the use of a silicon oil having reactive—OH functional groups makes it possible, by reaction with the —OH functional groups of said organosilicon compound(s) present, to stabilize, at a higher temperature, the film of said compound(s) at the surface of the cellulosic substrate.

Thus, for good impregnation of the surface of materials to be carbonized, it is therefore recommended to use nonvolatile organosilicon compounds, as a mixture with a film-forming agent (advantageously chosen from nonreactive and reactive silicon oils), dissolved in a solvent.

Such a film-forming agent is generally used in an amount from 10 to 50% by weight with respect to the weight of (nonvolatile) organosilicon compound(s).

If the organosilicon compound(s) involved is (are) volatile (i.e. it (they) distills (distill) quantitatively well below 400° C.), it is not conceivable to impregnate the substrate to be carbonized therewith. In this situation, the cellulosic fibrous materials are carbonized in the presence of its (their) vapor. The carbonization is in fact carried out, at least in part, advantageously at least in its first phases, in the presence of such volatile organosilicon compound(s).

Said compound(s) is (are) generally used in an inert gas.

It may also be pointed out here, in general, that the organosilicon compounds selected according to the invention are used, of course, in an effective amount, generally from 1 to 10% by weight, with respect to the weight of cellulosic materials. They have to be used in sufficient quantity to observe the expected effect, but not in excessive quantity as then an inopportune bonding effect may be observed. A person skilled in the art is capable of optimizing the amount of organosilicon compounds to be used, the use of which is recommended within the context of the method of the invention.

The inventors have also noted that the beneficial effect of said organosilicon compounds could be further enhanced by the combined use of a mineral additive.

According to a preferred variant for implementing the method of the invention, the cellulosic fibrous materials are thus also impregnated, before they are carbonized, with at least one mineral additive, a Lewis acid or base.

Said mineral additive may especially be chosen from ammonium and sodium halides, sulfates and phosphates, urea and mixtures thereof.

Advantageously, it consists of ammonium chloride ($NH_4Cl$) or diammonium phosphate [$(NH_4)_2HPO_4$].

The method may thus involve two successive impregnations of the cellulosic fibrous material to be carbonized (one with a nonvolatile organosilicon compound and the other with a mineral additive, in any order) or one impregnation of said fibrous material, prior to it being carbonized in the presence of a volatile organosilicon compound (impregnation with the mineral additive) . . . Its variants are not limiting . . .

According to another preferred variant of implementing the method of the invention, instead of a prior impregnation with a mineral additive, the carbonization is initiated in an atmosphere which contains hydrogen chloride (gaseous HCl). Said atmosphere generally contains said hydrogen chloride, diluted with air or with nitrogen. The carbonization is said to be initiated insofar as it generally involves the first step of the heat treatment (carried out continuously or batchwise—see below) after which the carbonized cellulosic fibrous material is obtained. Said first step is generally carried out between 100 and 250° C. To be exact, it may more specifically be termed the relaxation-dehydration step, preliminary to the actual carbonization.

When such a mineral additive is used, it is possible to obtain very promising results, especially high strengths in the case of carbon fibers and to do so with a better carbon yield (from 25 to 30%) than that obtained without said additive (from 15 to 20%).

As already indicated, the additives of the invention are advantageously used, both in carbonization processes carried out batchwise and in carbonization processes carried out continuously. It has been seen that they make it possible to carry out certain carbonizations continuously (which carbonizations were, according to the prior art, only possible to carry out batchwise).

According to a preferred implementation variant, the method of the invention is thus carried out continuously.

Finally, it will be recalled that the method of the invention—carbonization of cellulosic fibrous materials in the presence of specific organosilicon compounds—is particularly beneficial in that it allows effective carbonization, batchwise and continuously, of any type of cellulose, packaged in various forms.

The cellulosic fibrous material may especially be in the form of textile yarns or surfaces (wovens, knits, felts, nonwovens, unidirectional webs, unidirectional tapes, . . . ).

Said cellulosic fibrous material may especially consist of any type of rayon or staple fiber. The method of the invention. is, in this case, particularly beneficial: it results, used with products widely available on the market, in high-quality fibrous carbon materials. According to the prior art, such high-quality materials could be obtained only from cellulosic fibrous materials of a very particular type.

It is therefore recommended to implement the method of the invention—the use of the organosilicon compounds described above—in the carbonization of such cellulosic substrates, widely available on the market, such as the rayons intended hitherto for reinforcing tires.

Of course, the field of application of said method is not limited to the carbonization of these substrates . . .

The invention will now be illustrated by the examples below.

EXAMPLE 1

A 3680 dtex high-tenacity cellulose yarn (super 3 type), having a strength of 50 cN/tex (12.7 μm filament diameter), was desized by perchloroethylene and impregnated with 3% by weight of a mixture of an MQ resin and of a noncatalyzed reactive silicon oil sold by Rhodia Silicones (under the reference: RHODORSIL RTV 121).

The impregnation was carried out by immersing the yarn in a 3.5 wt % solution of said mixture in perchloroethylene. After removing the perchloroethylene, the yarn was pyrolyzed, being free to shrink (0.0049 N; 0.5 gf) according to the thermal profile below:

at 170° C., for 90 min, in air;

in succession: 230° C., 285° C., 315° C., 330° C., 400° C., 485° C., 555° C. and 655° C., for 5 min at each of these temperatures, in nitrogen;

at 1 200° C., for 2.5 min, in nitrogen.

This pyrolysis, carried out batchwise within the context of the example, could just as well have been carried out continuously.

The carbon filaments extracted from the yarn had a strength of 1 125 MPa and a modulus of 40 GPa for a diameter of 5.8 μm. The shrinkage during carbonization was 40%.

The carbonization yield was 16%.

EXAMPLE 2

A cellulose yarn identical to that of example 1, after desizing with perchloroethylene, was impregnated with 2 wt % of a 40% (by weight) mixture of MQ resin (25% M units: —O—$Si(CH_3)_3$, 25% $Q_3$ units: $SiO_3$—OH and 50% $Q_4$ units: $SiO_4$) of number-average molecular mass $M_n$=4 700, having an —OH— content of 1.7 mmol/g dissolved in 60% (by weight) of a nonreactive poly-methylsiloxane oil of number-average molecular mass $M_n$=25 000.

The impregnation was carried out by passing the yarn through a 2.5 wt % solution of the solution of the MQ resin and the nonreactive siloxane oil mixture in perchloroethylene. After the perchloroethylene was removed, the yarn was pyrolyzed under tension of 0.53 N (54 gf) according to the thermal profile specified in example 1.

The carbon filaments extracted from the yarn had a strength of 1 800 MPa and a modulus of 66 GPa, for a diameter of 4.4 μm. The elongation during carbonization was 7.1%.

The carbonization yield was 16.1%

EXAMPLE 3

A mesophase cellulose yarn (having a tensile strength of 100 cN/tex), manufactured according to the teaching of patent application EP-A-0 179 822 (Michelin), of 1 900 dtex (average filament diameter: 12.5 μm), was desized, impregnated with the organosilicon additive as in example 2 and pyrolyzed under tension of 0.39 N (40 gf) according to the thermal profile specified in example 1.

The carbon filaments extracted from the yarn had a strength of 1 800 MPa and a modulus of 100 GPa. The diameter was 3.8 μm and the elongation during carbonization was 52%.

The carbonization yield was 17.3%.

EXAMPLE 4

A cellulose yarn identical to that of example 1, after desizing with perchloroethylene, was pyrolyzed directly according to the thermal profile specified in example 1 except, however, that, up to 485° C. the pyrolysis was carried out in nitrogen enriched with tetraethylorthosilicate vapor, said tetraethylortho-silicate being contained in a silica crucible and permanently maintained at a temperature half that of the fibers; this therefore being done until said temperature of the fibers reached 485° C., at which temperature said tetraethylorthosilicate was removed. The tetraethylorthosilicate used was that sold by Bayer under the reference TES 40.

The carbon filaments extracted from the yarn had a strength of 930 MPa and a modulus of 38 GPa for a diameter of 5.5 μm. The carbonization shrinkage along the axis of the fibers was 38%.

The carbonization yield was 14.5%.

EXAMPLE 5

A cellulose yarn identical to that of example 1 was desized and then impregnated with the organosilicon additive as in example 1. It was then impregnated with 8% by weight of $NH_4Cl$ by passing it through a 13 wt % aqueous solution of said $NH_4Cl$.

The yarn was dried at 100° C. for 30 min and the excess $NH_4Cl$ was removed by rinsing for a few seconds in distilled water.

Said yarn was dried at 100° C. for 1 hour and then underwent pyrolysis at 1 200° C. as in example 1.

The tensile strength of the carbon filaments extracted from said carbonized yarn was 1 200 MPa and their modulus was 45 GPa, for a diameter of 8.3 μm. The shrinkage during carbonization was 32.3%.

The carbonization yield was 30%.

EXAMPLE 6

A cellulose yarn identical to that of example 1 was desized and then impregnated with the organosilicon additive as in example 1. It was then pyrolyzed according to the thermal profile in example 1, but with the 170° C./90 min step in air replaced with a 170° C./90 min step in a (1/1) $HCl/N_2$ mixture.

The tensile strength of the carbon filaments extracted from said carbonized yarn was 1 350 MPa, their modulus was 50 GPa and their diameter was 8.6 μm. The shrinkage during carbonization was 31.5%.

The carbonization yield was 27%.

EXAMPLE 7 (COMPARATIVE EXAMPLE)

A cellulose yarn identical to that of example 1 was desized with perchloroethylene and then, without being impregnated with the polysiloxane additive, it was pyrolyzed according to the thermal profile indicated in said example 1.

The tensile strength of the carbon filaments extracted from the yarns obtained was only 660 MPa and their modulus was 38 GPa. The diameter of said filaments was 5.8 μm.

The invention claimed is:

1. A method comprising continuously or batchwise obtaining fibrous carbon materials by carbonization of cellulosic fibrous materials in the presence of at least one organosilicon compound, wherein said organosilicon compound is chosen from a family of crosslinked, cyclic or branched oligomers and resins having a number-average molecular mass of between 500 and 10,000 and consisting of units of formula $SiO_4$ and units of formula $SiO_xR_y(OR')_z$, x, y and z being integers such that $x+y+z=4$ and $1x\leqq 3$, $0\leqq y\leqq 3$ and $0\leqq z\leqq 3$, R representing hydrogen, or a linear or branched alkyl radical having from 1 to 10 carbon atoms, different R groups being capable of occurring in the same unit when $y\geqq 2$, R' representing, independently of R, hydrogen, or a linear or branched alkyl radical having from 1 to 10 carbon atoms, different R' groups being capable of occurring in the same unit when $z\geqq 2$ given that for oligomers having a number-average molecular mass of less than 1,000, $z\neq 0$ in said formula $SiO_xR_y(OR')_z$ and for resins having a number-average molecular mass of more than 2,000, $y\neq 0$ in said formula $SiO_xR_y(OR')_z$;

subjecting said cellulosic fibrous materials to said carbonization so as to provide said fibrous carbon materials with filaments of increased strength compared to filaments from said carbonization performed in the absence of said organosilicon compound.

2. A method comprising continuously or batchwise obtaining fibrous carbon materials by carbonization of cellulosic fibrous materials in the presence of at least one organosilicon compound, wherein said organosilicon compound is chosen from a family of crosslinked, cyclic or branched oligomers and resins having a number-average molecular mass of between 500 and 10,000 and consisting of units of formula $SiO_4$ and units of formula $SiO_xR_y(OR')_z$, x, y and z being integers such that $x+y+z=4$ and $1\leqq x\leqq 3$, $0\leqq y\leqq 3$ and $0\leqq z\leqq 3$, R representing hydrogen, or a linear or branched alkyl radical having from 1 to 10 carbon atoms, different R groups being capable of occurring in the same unit when $y\geqq 2$, R' representing, independently of R, hydrogen, or a linear or branched alkyl radical having from 1 to 10 carbon atoms, different R' groups being capable of occurring in the same unit when $z\geqq 2$ given that for oligomers having a number-average molecular mass of less than 1,000, $z\neq 0$ in said formula $SiO_xR_y(OR')_z$ and for resins having a number-average molecular mass of more than 2,000, $y\neq 0$ in said formula $SiO_x(OR')_z$;

subjecting said cellulosic fibrous materials to said carbonization so as to provide said fibrous carbon materials with filaments of strengths from about 930 to 2,000 megapascals.

3. The method of claim 2, wherein said organosilicon compound is a siloxane resin consisting of units of formula $SiO_4$, units of formula $SiO_3$—OH and units of formula O—Si—$R_3$ or consisting of $n_1$ $SiO_4$ units, $n_2$ $SiO_3$—OH units and $n_3$ O—Si—$R_3$ units with $2\leqq n_1\leqq 70$, $3\leqq n_2\leqq 50$ and $3\leqq n_3\leqq 50$ and having a number-average molecular mass of between 2,500 and 5,000.

4. The method of claim 2, wherein said organosilicon compound is chosen from oligomers of a partially hydrolyzed organic silicate, oligomers of a partially hydrolyzed alkyl silicate or oligomers of a partially hydrolyzed ethyl silicate.

5. The method of claim 2, wherein said organosilicon compound is not volatile and said cellulosic fibrous materials are impregnated with said organosilicon compound prior to said carbonization.

6. The method of claim 5, wherein said organosilicon compound is provided as a mixture with a film-forming agent chosen from reactive or nonreactive silicon oils dissolved in a solvent.

7. The method of claim 5, wherein said organosilicon compound is provided as a mixture with a silicon oil having a viscosity of between 500 and 5,000 centipoise.

8. The method of claim 2, wherein said organosilicon compound is volatile and said cellulosic fibrous materials undergo said carbonization in the presence of said organosilicon compound vapors.

9. The method of claim 2, wherein said cellulosic fibrous materials are impregnated with at least one mineral additive, a Lewis acid or base prior to said carbonization.

10. The method of claim 9, wherein said mineral additive is chosen from ammonium halides, sodium halides, sulfates, phosphates, urea or mixtures thereof, or consisting of ammonium chloride or diammonium phosphate.

11. The method of claim 2, wherein said carbonization is carried out continuously.

12. The method of claim 2, wherein said carbonization is carried out batchwise.

13. The method of claim 2, wherein said cellulosic fibrous materials consist of textile yarns or surfaces comprising wovens, knits, felts, nonwovens, unidirectional webs or unidirectional tapes.

14. The method of claim 2, wherein said cellulosic fibrous materials are rayons suitable for reinforcing tires.

* * * * *